US005840471A

United States Patent [19]

Fukuwatari et al.

[11] Patent Number: 5,840,471

[45] Date of Patent: Nov. 24, 1998

[54] METHOD FOR PROCESSING SILVER HALIDE PHOTOGRAPHIC LIGHT-SENSITIVE MATERIAL

[75] Inventors: Naoko Fukuwatari; Eiichi Ueda; Yasuo Kurachi, all of Hino, Japan

[73] Assignee: Konica Corporation, Japan

[21] Appl. No.: 938,233

[22] Filed: Sep. 26, 1997

[30] Foreign Application Priority Data

| | | | |
|---|---|---|---|
| Oct. 2, 1996 | [JP] | Japan | 8-261754 |
| Oct. 23, 1996 | [JP] | Japan | 8-280753 |
| Apr. 18, 1997 | [JP] | Japan | 9-101496 |
| Jun. 17, 1997 | [JP] | Japan | 9-159870 |

[51] Int. Cl.[6] ..... G03C 5/31

[52] U.S. Cl. ..... 430/399; 430/398; 430/428; 430/429; 430/488; 430/490; 430/523

[58] Field of Search ..... 430/398, 399, 430/428, 429, 488, 490, 523

[56] References Cited

U.S. PATENT DOCUMENTS

| | | | |
|---|---|---|---|
| 4,663,420 | 5/1987 | Chang | 528/168 |
| 5,135,846 | 8/1992 | Mukunoki et al. | 430/637 |
| 5,288,728 | 2/1994 | Spears et al. | 210/729 |

FOREIGN PATENT DOCUMENTS

| | | |
|---|---|---|
| 304296 | 2/1989 | European Pat. Off. . |
| 614115 | 9/1994 | European Pat. Off. . |

OTHER PUBLICATIONS

Y. Tomokazu, "Silver Halide . . . Material", JP 04 149, 433 May 22, 1992, Patent Abstracts of Japan, Abstract Only.

Allcock et al, "Poly(organophosphazenes) . . . Hydrogels", Macromolecules, vol. 25, No. 21, Oct. 12, 1992, pp. 5573–5577.

*Primary Examiner*—Hoa Van Le

*Attorney, Agent, or Firm*—Jordan B. Bierman; Bierman, Muserlian and Lucas

[57] ABSTRACT

A method for processing a silver halide photographic light-sensitive material is disclosed. The method comprises the steps of developing the silver halide photographic light-sensitive material with a developing solution and contacting the developing solution to a member comprising the particles of a water-insoluble compound having the structural unit represented by Formula 1 and/or the particles of the water-insoluble compound represented by Formula 2;

Formula 1

Formula 2

11 Claims, No Drawings

METHOD FOR PROCESSING SILVER HALIDE PHOTOGRAPHIC LIGHT-SENSITIVE MATERIAL

FIELD OF THE INVENTION

This invention relates to a method for processing a silver halide photographic light-sensitive material, particularly relates to a method for processing a silver halide photographic light-sensitive material by which a silver sludge is hardly formed even when the processing is a rapid processing with a reduced amount of replenisher.

BACKGROUND OF THE INVENTION

A silver halide photographic light-sensitive material is generally processed, after imagewise exposure, by four processes, developing, fixing, washing and drying. The developing process is usually carried out by using a developing solution containing hydroquinone and phenidone or metol in combination. A sulfite salt is usually contained in the developing solution to prevent oxidation of the developing agent and to improve the storage ability of the developing solution since the development is carried out under an alkaline condition. In such the case, the silver salt is dissolved out of the silver halide photographic material into the developing solution since the sulfite has an ability to dissolve silver halide. The silver salt dissolved in the developing solution is easily reduced to form a precipitate of metallic silver. The precipitated silver is adhered to the surface of the light-sensitive material or the interior wall of the developing tank and causes a silver stain. The problem of silver stain is particularly raised in a rapid processing at a high temperature using a transportation type automatic processor.

Such the problem is become serious when the amount of a developer replenisher to be replenished to the developing solution is lower with respect to the amount of the light-sensitive material to be processed, since the concentration of the precipitation is made relatively higher. To solve the problem, a compound has been investigated, which raises the storage ability of the processing solution by preventing the dissolution of the silver salt. However, such the compound has not be found yet. On the other hand, a means for preventing the precipitation by trapping the silver salt dissolved out of the light-sensitive material has been also investigated.

For example, a 2-mercapto-1,3,4-thiazole compound described in British Patent (BP) No. 940,169, a 2-mercapto-1,3,4-oxadiazole compound and a 1-phenyl-5-mercaptotetrazole compound described in U.S. Pat. No. 3,173,789, a D,L-6,8-dithiooctanic acid described in U.S. Pat. No. 3,318,701, an o-mercaptobenzoic acid described in BP No. 1,144,481, an aliphatic mercaptocarboxylic acid described in BP No. 3,628,955, a 1-thiazolidine-4 carboxylic acid described in J. Photogr. Sci., 13, 233 (1965), a disulfide compound described in Japanese Patent Open to Public Inspection (JP O.P.I.) No. 52-36029, a 2-benzoxazolethiol, 2-benzimidazolethiol compound described in J. Photogr. Sci. Eng., 20, 220 (1976), an acetylene glycol described in JP O.P.I. No. 55-95947 and a 2-mercaptobenzothiazole-5-sulfonic acid described in JP O.P.I. No. 56-72441 have been known as agents for preventing the silver sludge or contamination of the processing solution.

However, these compounds do not satisfy the requirements when the compounds are used as sludge preventing agents in a developing solution having the silver halide dissolving ability, particularly in a developing solution having a high concentration of sulfite such as 0.2 moles/liter or more, since the compounds have such drawbacks that the sludge preventing ability of the compound is lost by oxidation by air, a large amount of the compound is required since the sludge preventing ability of the compound is low, the compound gives a bad influence on the photographic properties of the light-sensitive material such as a desensitization, lowering in contrast or inhibition of development, the cost of the compound is too high or the compound has an unpleasant odor.

JP O.P.I. No. 64-50047 describes a method for preventing the formation of silver sludge by contacting a developer containing a silver complex which is dissolved from a light-sensitive material, with a cleaning film which comprises a film support having thereon a hydrophilic colloid layer containing an organic compound capable of adsorbing a silver ion or metallic silver. This method is characterized in that an organic compound capable of adsorbing a silver ion or metallic silver is used. However, such the compound has a drawback that the compound is high in the cost since the synthesis of the compound is difficult or requires many synthesizing steps.

JP O.P.I. 3-273236 describes a method for preventing the formation of silver sludge by contacting a developing solution containing a silver complex which is dissolved from a light-sensitive material processed, with a cleaning film or a cleaning paper each having a hydrophilic colloid layer which contains physical developing nuclei capable of causing a physical development of the silver complex contained in the developing solution. This method is characterized by the use of the cleaning film or paper having the physical development nuclei which is capable of adsorbing a silver ion or a silver complex. The cleaning film and paper have a drawback that the film and paper cannot be repeatedly used and the cost thereof is become high since the physical development nuclei are used for trapping the silver ion or silver complex.

SUMMARY OF THE INVENTION

The first object of the invention is to provide a method for processing a silver halide photographic material, by which the contamination of the light-sensitive material, a developing solution, a roller or a belt of a processor by silver sludge which is formed when a silver halide photographic light-sensitive material is processed by an automatic processor using a developing solution having an ability of dissolving silver halide, particularly, using a stable developing solution containing a high concentration of sulfite, can be considerably inhibited even if a rapid processing with replenishing by a reduced amount of replenisher is applied. Second object of the invention is to provide a method for preventing degradation of processing solution by which a photographic image excellent in the quality can be obtained.

The second object of the invention is to provide a processing method of a silver halide light-sensitive material by which a photographic image having an excellent quality without contamination or stain caused by the silver sludge.

The above-mentioned objects of the invention can be attained by a method for processing a silver halide photographic light-sensitive material comprising the steps of developing the silver halide photographic light-sensitive material with a developing solution and contacting said developing solution to a member comprising particles of a compound having a structural unit represented by Formula 1 and/or particles of a compound represented by Formula 2, the compound having a structural unit represented by Formula 1 and the compound represented by Formula 2 have each a solubility of not more than 1 g per 100 g of water at 40° C.;

Formula 1

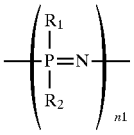

wherein $R_1$ and $R_2$ are each independently an alkyl group, an alkoxy group, an aryl group, an aryloxy group, an alkenyl group, an alkynyl group, an amino group, an alkylthio group, an arylthio group, an acyl group, a cyano group, a cyanato group, an isocyanato group, an isothiocyanato group or an azide group, $n_1$ is an integer of 1 to 50,000, when $n_1$ is 2 or more, $R_1$ and $R_2$ may be the same or different between the structural units;

Formula 2

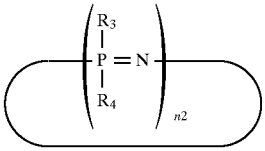

wherein $R_3$ and $R_4$ are synonymous with the group represented by $R_1$ and $R_3$ in Formula 1, $n_2$ is an integer of 3 to 20, and $R_3$ and $R_4$ may be the same or different between the structural units.

DETAILED DESCRIPTION OF THE INVENTION

The groups represented by in Formula 1 or 2 may each have a substituent. The alkyl group, alkenyl group and alkynyl group represented by $R_1$ to $R_4$ are preferably those each having 1 to 20 carbon atoms, respectively. Preferred group represnted by $R_1$ through $R_4$ includes, for example, a methoxy group, an ethyloxy group, a propyloxy group, butyloxy group, a benzyloxy group, a phenyloxy group, a trifluoroethyloxy group, a pentafluoropropyloxy group, a p-fluorophenyloxy group, p-chlorophenyloxy group, a dichlorophenyloxy group, a p-tolyloxy group, a phenyl group, an isocyanato group, an isothiocyanato group, a cyano group, a monophenylamino group, a monomethyl amino group, an ethylthio group, an azido group, a monopropylamino group, a phenylthio group, a methylcarbonyl group, a heptadecylcarbonyl group, a dimethylamino group, a diethylamino group, an amino group, a methylphenylamino group.

The compound having a structural unit represented by Formula 1, hereinafter referred to a compound of Formula 1 or the compound represented by Formula 2, hereinafter referred to a compound of Formula 2, is a phosphazene compound derivative having a skeleton of P=N bond. In Formula 1, $n_1$ is a positive integer of 1 or 50,000, preferably $1 \leqq n_1 \leqq 30{,}000$, more preferably $1 \leqq n_1 \leqq 10{,}000$, further preferably $1 \leqq n_1 \leqq 5{,}000$. In Formula 2, $n_2$ is a positive integer of 3 to 20, preferably $3 \leqq n_2 \leqq 8$, more preferably $3 \leqq n_2 \leqq 4$. These compound include compounds each having a linear P=N bond, compound each having a cyclic P=N bond and cyclic-linear compounds. The compounds of Formula 1 or 2 each has a solubility of 1 g per 100 g of water at 40° C. The compound represented by Formula 1 and that represented by Formula 2 can be used solely or in combination.

These compounds can be synthesized by the following method. In the method, a halogen atom of a trimer, tetramer or higher polymer of a compound having a side chain of fluorine such as $(PNF_2)_3$, $(PNF_2)_4$ or $(PNF_2)_n$, a trimer, tetramer or higher polymer of a compound having a side chain of chlorine such as $(PNCl_2)_3$, $(PNCl_2)_4$ or $(PNCl_2)_n$, a trimer, tetramer or higher polymer of a compound having a side chain of bromine such as $(PNBr_2)_3$, $(PNBr_2)_4$ or $(PNBr_2)_n$, or a trimer, tetramer or higher polymer of a compound having a side chain of iodine such as $(PNI_2)_3$, $(PNI_2)_4$ or $(PNI_2)_n$, is reacted by mixing with a halogen acceptable compound capable of electron attractively substituting the halogen atom on the phosphor atom, for example, a metal salt of an organic compound such as $C_6H_5ONa$, $CH_3C_6H_4ONa$, $(C_6H_5O)_2Ca$ or $CF_3CH_2ONa$, an organic compound having a hydroxyl group such as $C_6H_5OH$, an alcohol such as $CH_2(CH_3)=C—COOCH_2CH_2OH$, an amine such as aniline, sodium hydroxide or sodium carbonate.

Synthesis example

An example of synthesis of the later-mentioned phosphazene compound C-25 is as follows:

Hexachlorotriphosphazene is dissolved in 3 times in the amount of tetrahydrofuran. To this solution, 1.1 equivalent of sodium phenoxide dissolved in tetrahydrofuran is dropped, and refluxed for 5 hours. Then tetrahydrofuran is removed. The residue is extracted by an ethyl acetate. The extract is recrystallized from an ethyl acetate/hexane system. Thus the targeted compound can be obtained in a 90% yield.

Although the phosphazene compound is generally synthesized by the above-mentioned method, the synthesizing method of the compound is not particularly limited.

The combination of the side chain groups may be composed of the same groups or groups different from each other which are selected from the above-mentioned. The side chain groups may be selected so that the compound has a solubility of not more than 1 g per 100 ml of water. The group of side chain may be a substituent contained in a compound described in Chem. Rev., 1972, Vol. 172, No. 4, 315–356.

Examples of the compound represented by Formula (1) or (2) are described below. The compound usable in the invention is not limited thereto. In the following exemplified compounds, L represents a linear compound, C represents a cyclic compound and Hy is a cyclic-linear compound in which cyclic compounds are linked linearly or net-like.

In the following formulas, Me, Et, Pr-n, Pr-i, Bu-n and Ph are each represents a methyl group, ethyl group, n-propyl group, i-propyl group, n-butyl group and a phenyl group, respectively, and Mn is a number avrage molecular weight.

| | | |
|---|---|---|
| L-1 | $[NP(NCS)_2]_n$ | Mn = 300,000 |
| L-2 | $[NP(NCO)_2]_n$ | Mn = 280,000 |
| L-3 | $[NP(COCH_3)_2]_n$ | Mn = 300,000 |
| L-4 | $[NP(COC_{17}H_{35})_2]_n$ | Mn = 350,000 |
| L-5 | $[NP(CN)_2]_n$ | Mn = 280,000 |
| L-6 | $[NP(OMe)_2]_n$ | Mn = 280,000 |
| L-7 | $[NO(OEt)_2]_n$ | Mn = 300,000 |
| L-8 | $[NP(OCH_2CF_3)_2]_n$ | Mn = 3000,000 |
| L-9 | $[NP(OCH_2C_2F_5)_2]_n$ | Mn = 320,000 |
| L-10 | $[NP(OCH_2CH_2CF_2H)_2]_n$ | Mn = 320,000 |
| L-11 | $[NP(OCH_2C_3F_7)_2]_n$ | Mn = 340,000 |
| L-12 | $[NP(OCH_2CF_3)(OCH_2C_3F_7)]_n$ | Mn = 330,000 |
| L-13 | $[NP(OCH_2(CF_2)_6CH_3)_2]_n$ | Mn = 350,000 |

-continued

| | | |
|---|---|---|
| L-14 | $[NP(OCH_2C_2F_5)(OCH_2C_3F_7)]_n$ | Mn = 350,000 |
| L-15 | $[NP(OCH_2CF_2CF_2H)(OCH_2C_6F_{12}H)]_n$ | Mn = 380,000 |
| L-16 | $[NP(OPh)_2]_n$ | Mn = 220,000 |
| L-17 | $[NP(OC_6H_4F\text{-}p)_2]_n$ | Mn = 220,000 |
| L-18 | $[NP(OC_6H_4CF_3\text{-}m)_2]_n$ | Mn = 220,000 |
| L-19 | $[NP(OC_6H_4Cl\text{-}p)_2]_n$ | Mn = 230,000 |
| L-20 | $[NP(OC_6H_3Cl_2\text{-}2,4)_2]_n$ | Mn = 230,000 |
| L-21 | $[NP(OC_6H_4CH_3\text{-}p)_2]_n$ | Mn = 220,000 |
| L-22 | $[NP(OC_6H_4C_6H_5\text{-}p)_2]_n$ | Mn = 250,000 |
| L-23 | $[NP(NHPr\text{-}n)_2]_n$ | Mn = 280,000 |
| L-24 | $[NP(NHBu\text{-}n)_2]_n$ | Mn = 285,000 |
| L-25 | $[NP(NHPh)_2]_n$ | Mn = 300,000 |
| L-26 | $[NP(OMe_2)_2]_n$ | Mn = 280,000 |

-continued

| | | |
|---|---|---|
| L-27 | $[NP(NC_5H_{10})_2]_n$ | Mn = 300,000 |
| L-28 | $[NP(NEt_2)Cl]_n$ | Mn = 300,000 |
| L-29 | $[NP(NEt_2)(NHEt)]_n$ | Mn = 250,000 |
| L-30 | $[NP(NEt_2)(NHPr\text{-}n)]_n$ | Mn = 280,000 |
| L-31 | $[NP(NEt_2)(NHBu\text{-}n)]_n$ | Mn = 280,000 |
| L-32 | $(NPPh_2)_n$ | Mn = 220,000 |
| L-33 | $[NP(SEt)_2]_n$ | Mn = 250,000 |
| L-34 | $[NP(N_3)_2]_n$ | Mn = 200,000 |

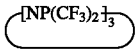
C-1

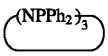
C-2

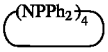
C-3

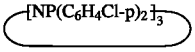
C-4

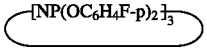
C-5

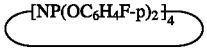
C-6

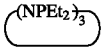
C-7

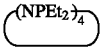
C-8

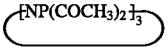
C-9

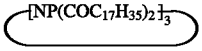
C-10

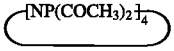
C-11

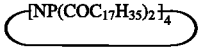
C-12

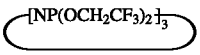
C-13

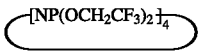
C-14

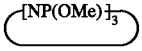
C-15

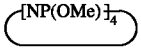
C-16

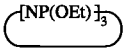
C-17

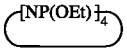
C-18

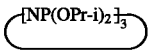
C-19

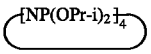
C-20

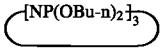
C-21

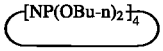
C-22

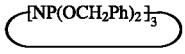
C-23

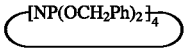
C-24

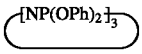
C-25

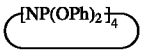
C-26

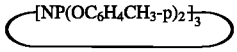
C-27

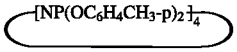
C-28

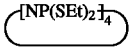
C-29

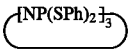
C-30

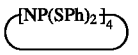
C-31

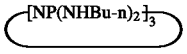
C-32

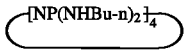
C-33

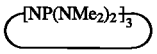
C-34

-continued
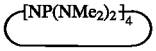
C-35
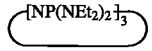
C-36
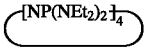
C-37
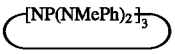
C-38
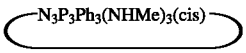
C-39
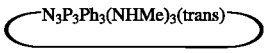
C-40
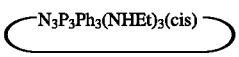
C-41
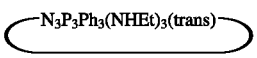
C-42
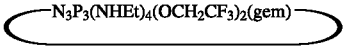
C-43
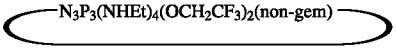
C-44
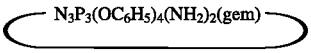
C-45
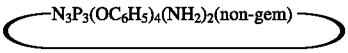
C-46
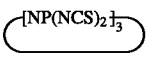
C-47
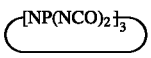
C-48
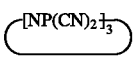
C-49
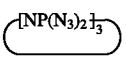
C-50
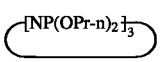
C-51
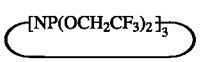
C-52
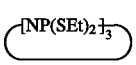
C-53
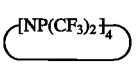
C-54
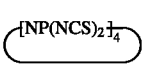
C-55
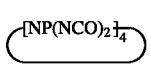
C-56
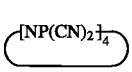
C-57
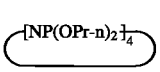
C-58
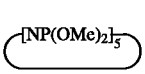
C-59
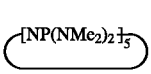
C-60
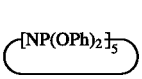
C-61
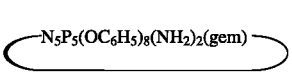
C-62
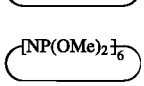
C-63
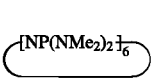
C-64
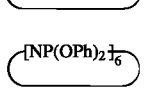
C-65
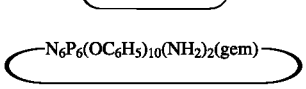
C-66
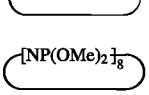
C-67
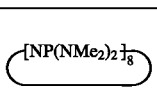
C-68
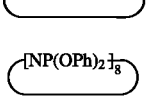
C-69
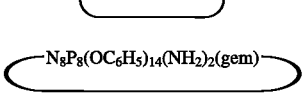
C-70
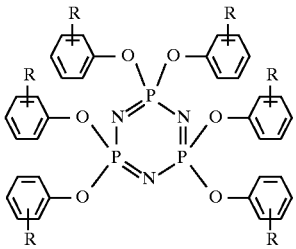
| | |
|---|---|
| R = $2NO_2$ | C-71 |
| $3NO_3$ | C-72 |
| $4NO_3$ | C-73 |
| $4CH_3$ | C-74 |
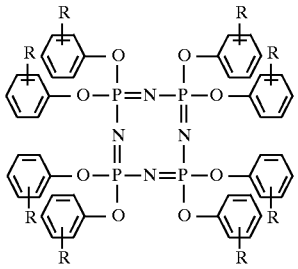
C-75
R = $4NO_2$ -continued
C-76
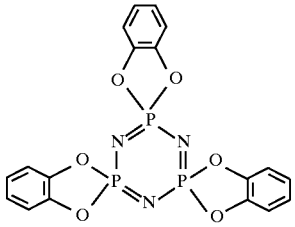
C-77
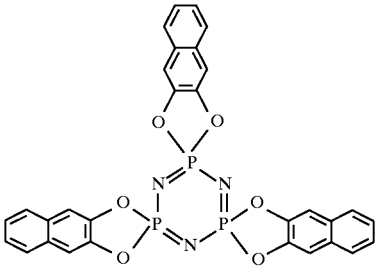
C-78
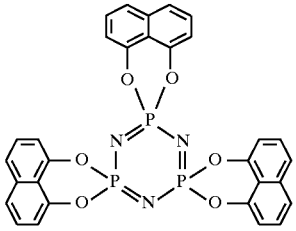
C-79
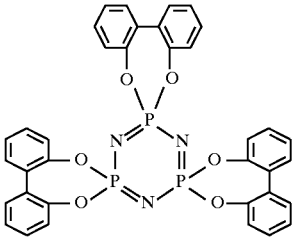
C-80
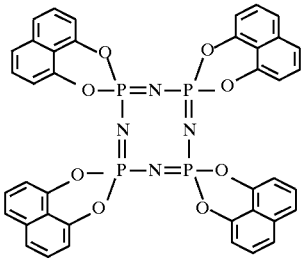
C-81
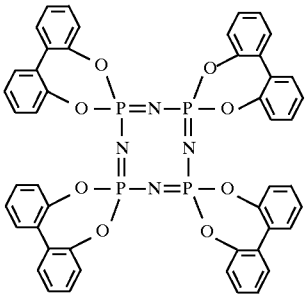
C-82
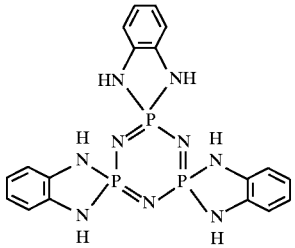
C-83
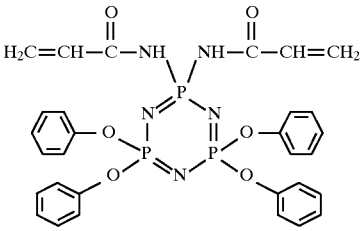
C-84
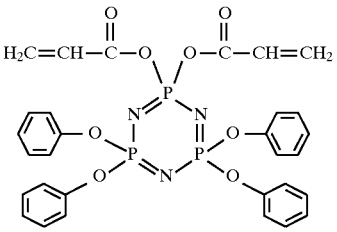
C-85
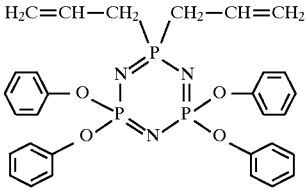
C-86
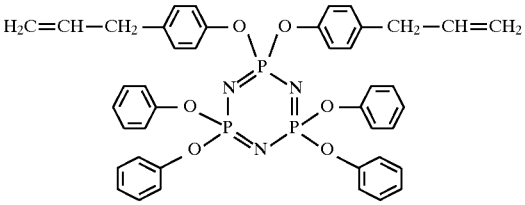
C-87
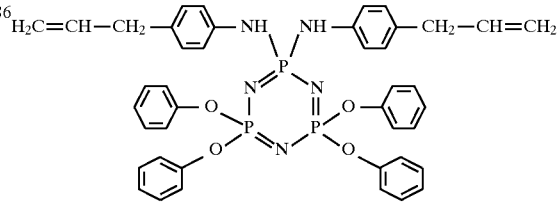

-continued
C-88
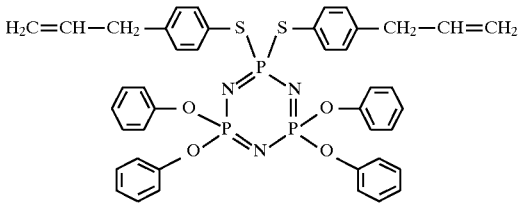
Hy-1
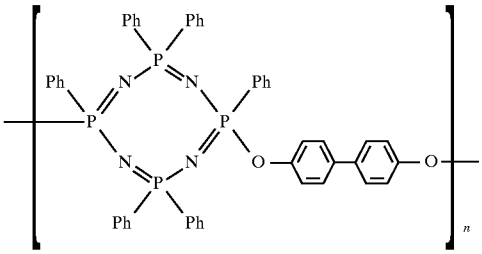
Mn = 20,000
Hy-2
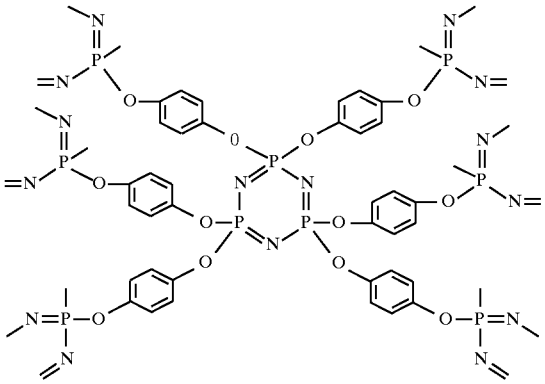
Mn = 50,000
Hy-3
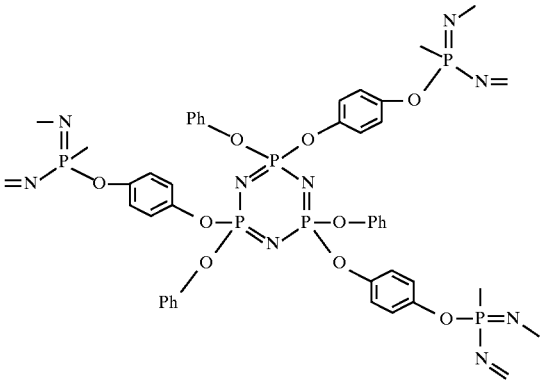
Mn = 50,000

-continued

Hy-4

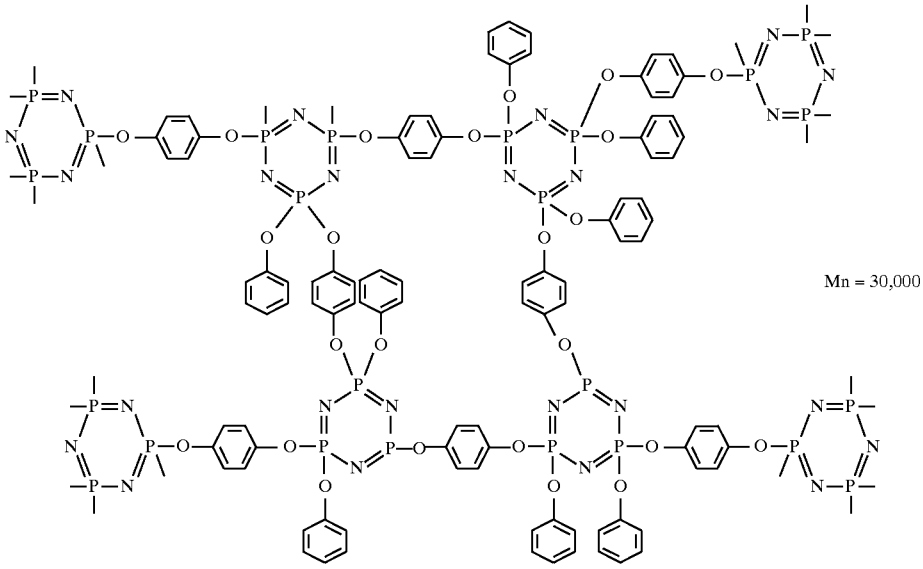

Mn = 30,000

In the invention, the compound of Formula 1 or 2 is used in a form fine particles. The particle can be prepared by dispersing the compound in a hydrophilic colloid, precipitating the compound in a hydrophilic colloid or mixing the finely powdered compound with a hydrophilic colloid. For example, the compound can be dispersed in an aqueous solution of a hydrophilic colloid by a method of power dispersion or dispersion under a reduced pressure, or a method of media dispersion using beads or ball-mill dispersing apparatus. However the method of dispersion is not particularly limited. The shape of the particle of the compound in the hydrophilic colloid may be spherical, needle-like or tabular without any limitation. In the invention, the diameter of the particle of the compound is preferably 10 nm to 100 $\mu$m, more preferably 50 nm to 10 $\mu$m, even though the diameter can be varied according to an adding condition.

There is no limitation of the form of the member containing the particles of the compound of Formula 1 or Formula 2, which is to be contacted with the developing solution. However, it is preferred that the member is made in the form of a cleaning sheet such as a cleaning film or a cleaning paper or a form of beads or a porous sheet. The cleaning sheet can be prepared by coating a hydrophilic colloid solution in which the particles of the compound of Formula 1 or 2 is dispersed by the method as above-mentioned on a support, or directly forming the hydrophilic colloid solution containing the particles of the compound into a film-shape. The cleaning sheet is passed through the developing tank at an appropriate interval according to the processed amount of the light-sensitive material. The beads or the porous sheet can be prepared by a method such as a spray-drying method. The beads and the porous sheet can be put in a developing solution-permeable container such as a bag or a case and immersed in the developing tank as a cleaning filter for developing solution.

As a preferable embodiment of such the sheet, a silver halide photographic light-sensitive material is used which comprises a support having thereon a silver halide emulsion layer and optionally a hydrophilic colloid layer, and at least one of the layer contains the particles of the compound of Formula 1 or 2. In such the case, the use of any specific mamber such as the cleaning sheet, or member such as the beads or poorous sheet is not necessary.

The compound of Formula 1 or 2 is preferably used in an amount of $2\times10^{-6}$ moles to 20 moles, more preferably $2\times10^{-5}$ moles to 2 moles, further preferably $2\times10^{-4}$ moles to $2\times10^{-1}$ moles, of the structural unit, per liter of developing solution. When the compound of Formula 1 or 2 is used in a form of sheet such as a cleaning film, a cleaning paper or a light-sensitive material, the amount of the compound is preferably 10 mg to 500 mg per square meter.

The compound of Formula 1 or 2 of the invention functions as an agent preventing the contamination by the silver stain or stain formed on the light-sensitive material or the wall of the processing tank or in the processing solution by adsorbing or trapping the silver ion or silver complex ion in the developing solution. Accordingly, the storage ability of the developing solution is improved and a rapid processing with a reduced amount of replenisher can be realized.

The cleaning film, cleaning paper, beads, filter or foamed sponge can be repeatedly used without any degradation of silver adsorbing ability since the ability to adsorb a silver ion or a silver complex ion of the compound of Formula 1 or 2 is easily recovered by washing with water. Accordingly, such the member can be used semipermanently and is advantageous from the viewpoint of cost.

As the light-sensitive material to be processed by the method of the invention, a light-sensitive material having a constitution ordinary applied in the field of the art is usable. The light-sensitive material is comprises a support and a silver halide emulsion layer provided on the support. The light-sensitive material can optionally have various hydrophilic colloid layers such as a protective layer an anti-halation layer, an interlayer, a filter layer and a backing layer. When the light-sensitive material is used as the sheet relating to the invention for preventing the silver sludge formation, the particles of the compound of Formula 1 or 2 is contained in at least one layer of the light-sensitive material, and the compound is preferably contained in the silver halide emulsion layer or a layer provided on the side of the emulsion layer farther from the support such as the protective layer.

Various compounds described in Research Disclosure (RD) Nos. 17643, 18716 (November 1979) and 308119 (December 1989) may be added to the silver halide photographic emulsion layer as photographic additives.

As a support of the light-sensitive material, one described in the foregoing RD-17643, RD-18716 (November 1979) and RD-308119 (December 1989) can be used. An appropriate support includes a plastic film. The surface of the support may be subjected to a treatment by corona discharge or UV irradiation to increase the adhesiveness with the coated layer.

In the invention, "contacting" means that the developing solution contacts with the compound of Formula 1 or 2, particularly, the particles of the compound contained in the above-mentioned cleaning sheet, beads, filter or foamed piece. Such the condition is different from the condition that the compound of Formula 1 or 2 is dissolved in the developing solution.

In the invention, the light-sensitive material can be processed by a processing solution, for example, described in Research Disclosure Nos. 17643 and 308119.

As the developing solution, a developing solution having a usual composition can be used. In the developing solution, a dihydroxybenzene and a 3-pyrazolidone compound may be used solely or in combination as the developing agent. A developing solution containing substantially no dihydroxybenzene may be used in the invention. In the developing solution, the following additives may be further added: a conservative, an alkaline agent, a pH buffer, an antifogant, a hardener, a sensitizer, a chelating agent, a development accelerator, a surfactant, a defoaming agent, a toning agent, a dissolving aid or a thickener. The pH value of the developing solution is preferably adjusted to 8.5 to 12.0, more preferably 9.0 to 10.9.

A fixing solution having an usual composition can be used. The fixing solution is an aqueous solution containing a fixing agent and another component. The pH value of the fixing agent is usually 3.8 to 5.8. A fixing agent usually known can be used as the fixing agent. The fixing agent can further contains a hardener, a preservant, a pH buffer, a pH controlling agent or a chelating agent according to necessity.

The initial solution and the replenisher of the developing solution, the fixing solution and another solution such as a stabilizing solution are each supplied usually in a form of a using solution or a diluted solution of a concentrated solution which is diluted at a time just before the supply of the solution. The initial solution and the replenishing solution of the processing solution may be stored in a form of a using solution, a concentrated solution or a past of a high viscous solution. The processing solution may be prepared by dissolving a solid composition or a mixture thereof at a time just before the use thereof. In the case of the mixture, the mixture can be vacuum-packed in which the components are packed so that layers of the components each hardly react with each other are adjoined, and the vacuum package is open at the time of use. The mixture also may be made in a formed of tablet.

The developing process is preferably carried out at a temperature of 20° C. to 50° C. It is preferred in the invention that the light-sensitive material is processed by an automatic processor. When by the automatic processor is used, a certain amounts of a developing solution replenisher and a fixing solution replenisher proportional to the area of the light-sensitive material processed are supplied while the processing. The replenishing amounts of the developing solution and the fixing solution are each preferably not more than 330 ml per square meter of light-sensitive material for reducing the amounts of waste liquids. A preferable amount of the replenishing solution for the developing solution is 60 to 260 ml, and that of the replenishing solution of the fixing solution is 60 to 330 ml, per square meter.

It is preferred that the total processing time of dry to dry, namely an interval between the time at which the front edge of the light-sensitive material is inserted into the processor to the time at which the front edge of the light-sensitive material is come out from the drying zone of the processor, is 10 to 40 seconds. The "total processing time" includes all the time necessary to process the light-sensitive material, for example, developing, fixing, bleaching, washing, stabilizing and drying in concrete. The total processing time is more preferably 20 to 40 seconds.

EXAMPLES

Example 1

<Preparation of cleaning sheet>

On a polyethylene terephthalate support of 100 μm which has been subbed and treated with corona discharge, the following gelatin solution was coated using a roll-fit-coating pan and an air knife with a speed of 70 m/min so that the coating amount was the followings. The comparative compounds and the compounds of the invention were sufficiently powdered before adding to the solution so that the average size of the powdered particles was not more than 100 nm.

| | |
|---|---|
| Gelatin | 1.6 g/m$^2$ |
| Hardener $(CH_2{=}CHSO_2CH_2)_2O$ | 36 mg/m$^2$ |

Sodium salt of 2,4-dichloro-6-hydroxy-

| | |
|---|---|
| 1,3,5-triazine | 10 mg/m$^2$ |

Comparative compound or compound of

| | |
|---|---|
| Formula 1 or 2 (See Table 1) | 1.2 g/m$^2$ |

The coated sheet was dried at 90° C. for 2 minutes and heated at 140° C. for 90 seconds. Thus cleaning sheets No. 4 through 9 according to the invention and comparative cleaning sheets No. 1 through 3 were prepared.

<Preparation of silver halide light-sensitive material>

(Preparation of support having an electric conductive layer)

On a polyethylene terephthalate support of 100 μm which has been subbed and treated with corona discharge, the following antistatic solution was coated using a roll-fit-coating pan and an air knife with a speed of 70 m/min so that the coating amount was the followings.

| | |
|---|---|
| Water-soluble electric conductive polymer P-1 | 0.6 g/m$^2$ |
| Hydrophilic polymer particles P-2 | 0.4 g/m$^2$ |
| Polyethylene oxide compound Ao-1 | 0.06 g/m$^2$ |
| Hardener E-1 | 0.2 g/m$^2$ |

The antistatic solution was coated on one side of the support. The coated layer was dried at 90° C. for 2 minutes and heated at 140° C. for 90 seconds.

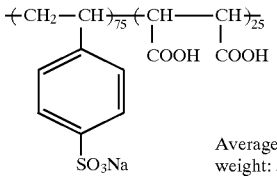

P-1

Average molecular weight: 5,000

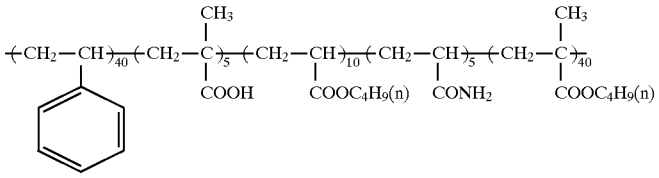

P-2

$HO(CH_2CH_2O)_nH$ [n = 15] Ao-1

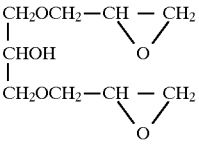

E-1

(Preparation of silver halide emulsion)

A silver chloroiodobromide emulsion composed of 62 mole- % of silver chloride, 0.5 mole- % of silver iodide and 37.5 mole- % of silver bromide was prepared by a double-jet mixing method.

During a period of the mixing process in which the average diameter of silver halide grain was grown from 5% of the average diameter to be finally attained to the average diameter to be finally attained, $8\times10^{-8}$ moles per mole of silver halide of potassium hexabromorhodate and $8\times10^{-7}$ moles per mole of silver halide of potassium hexachloroiridate were added.

Thus obtained emulsion was desalted by an usual flocculation method using gelatin modified by phenylisocyanate, and the flocculate was redispersed in a gelatin solution. Then the following anti-mold agents were added. Thus an emulsion comprising cubic monodisperse grains having an average diameter of 0.30 $\mu$m and a variation coefficient of grain size distribution of 10%.

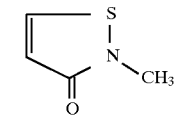

(A)

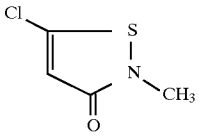

(B)

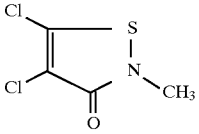

(C)

(Mixture of 30:30:40 by in molar ratio)

To the emulsion, citric acid, sodium chloride and 1-phenyl-5-mercaptotetrazole were added. Then the emulsion was chemically ripened at 60° C. after addition of chloroauric acid and sodium thiosulfate. To stop the ripening, 1 g per mole of silver halide of 4-hydroxy-6-methyl-1,3,3a,7-tetraazaindene was added to the emulsion after the sensitivity of the emulsion was attained to the maximum value. Then 600 mg of potassium bromide and 150 mg of the following sensitizing dye SD-1 per mole of silver halide were added to the emulsion.

(Preparation of emulsion coating liquid)

To the emulsion, the following additives were added per mole of silver halide to prepare an emulsion coating liquid: 4 g of hydroquinone, 15 g of polymer latex P-3, 150 mg of inhibitor 150 mg, 2 g of styrene-maleic acid copolymer, 1N-solution of sodium hydroxide, 1.5 g of compound S-1, saponine as a coating aid, and sodium salt of 2,4-dichloro-6-hydroxy-1,3,5-triazine as a hardener.

(Preparation of emulsion protective layer coating liquid)

A coating liquid of a protective layer for the emulsion layer was prepared so that the coating amounts of the components were as follows: 1.1 g/m$^2$ of gelatin, 1 mg/m$^2$ of an adduct of sodium bisulfate and formaldehyde, 5.5 mg/m$^2$ of 1 phenyl-4-hydroxymethyl-3-pyrazolidone, 15 mg/m$^2$ of monodispersed silica having an average size of 3 $\mu$m and 15 mg/m$^2$ of monodispersed silica having an average size of 8 $\mu$m. Further compound S-2 as a coating aid, citric acid, formalin as a hardener, and $3\times10^{-6}$ moles/m$^2$ of a fluorized surfactant FA-1 were added to the liquid.

(Preparation of backing layer coating liquid)

A coating liquid of a backing layer was prepared so that the coating amounts of the components were as follows: 2.3 g/m$^2$ of gelatin, 100 mg/m$^2$ of water-soluble dye 1, 25 mg/m$^2$ of water-soluble dye 2, 100 mg/m$^2$ of water-soluble dye 3, 60 mg/m$^2$ of styrene-maleic acid copolymer, 150 mg/m$^2$ of colloidal silica, a mixture of compound A, B and C, sodium dodecylbenzenesulfonate as a coating aid, and glyoxal and 55 mg/m$^2$ of E-1 as hardeners.

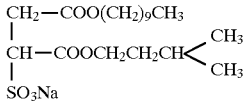

S-2

-continued

SD-1

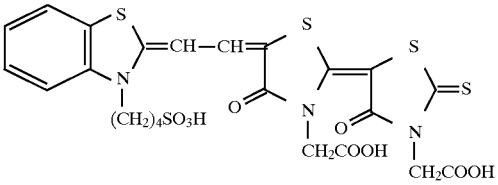

P-3

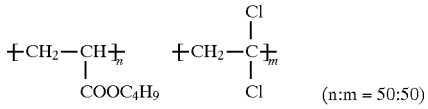

E-2

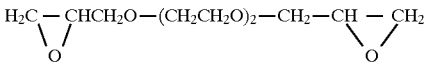

ST-1

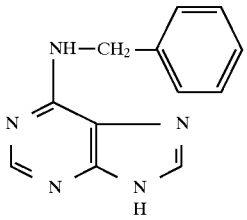

S-1

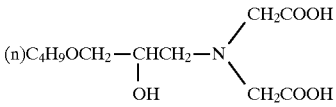

FA-1

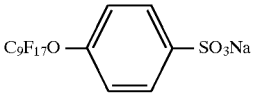

Water-soluble dye 1

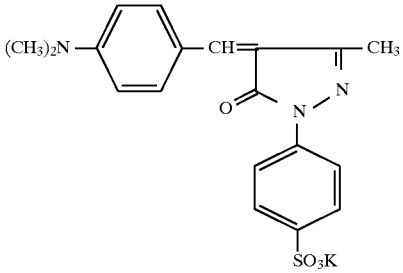

Water-soluble dye 2

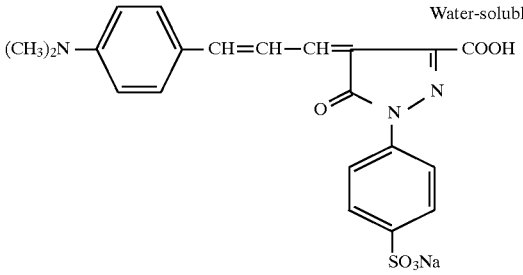

Water-soluble dye 3

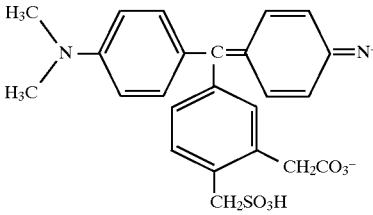

(Preparation of backing protective layer coating liquid)

A coating liquid of a protective layer for the backing layer was prepared so that the coating amounts of the components were as follows: 0.7 g/m$^2$ of gelatin, 7 mg/m$^2$ of compound S-2, a dispersion of monodispersed particles of polymethyl methacrylate having an average size of 5.5 $\mu$m, a mixture of compounds A, B and C and styrene-maleic acid copolymer. To the coating liquid, glyoxal and sodium salt of 4-dichloro-6-hydroxy-1,3,5-triazine were further added as hardeners.

(Preparation of sample of light-sensitive material)

The surface of the polyethylene terephthalate support, on which the antistatic layer had been provided, was subjected to 15 W/m$^2$-min. of corona discharge. On the antistatic layer, the above-prepared backing layer coating liquid and backing protective layer coating liquid were coated. On the other surface of the support, the above-prepared emulsion layer coating liquid and emulsion protective layer were coated after treatment by 15 W/m$^2$-min. of corona discharge. Then the coated layers were dried. The emulsion layer was coated so that the coating amounts of silver and gelatin were each 4.0 g/m$^2$, and 1.7 g/m$^2$, respectively, and dried.

Thus prepared light-sensitive material was wedgewise exposed to He-Ne laser light for $10^{-6}$ seconds. Then the light-sensitive material was processed by an automatic processor for graphic arts light-sensitive material GQ-26SR, manufactured by Konica Corp., using the following developing solution and fixing solution under the following conditions.

| <Processing solution> Developing solution | |
|---|---|
| (Composition A) | |
| Pure water | 150 ml |
| Disodium ethylenediaminetetraacetate | 2 g |
| Ethylene glycol | 50 g |
| Potassium sulfite (55 w/v % aqueous solution) | 130 ml |
| Potassium carbonate | 50 g |
| Hydroquinone | 15 g |
| 5-methylbenzotriazole | 200 mg |
| Potassium hydroxide | An amount necessary to make the pH value 10.5 |
| Potassium bromide | 4.5 g |
| (Composition B) | |
| Pure water | 3 ml |
| Ethylene glycol | 50 g |
| Disodium ethylenediaminetetraacetate | 25 mg |
| Acetic acid (90% aqueous solution) | 0.3 ml |
| 5-nitroindazole | 110 mg |
| 1-phenyl-3-pyrrolidone | 500 mg |

Compositions A and B were dissolved in 500 ml of water and make to 1 liter by adding water at the time of use.

| Fixing solution | |
|---|---|
| (Composition A) | |
| Ammonium thiosulfate (72.5 w/v % aqueous solution) | 230 ml |
| Sodium sulfite | 9.5 g |
| Sodium acetate trihydrate | 28 g |
| Boric acid | 6.7 g |
| Sodium citrate dihydrate | 2 g |
| Acetic acid (90 w/w % aqueous solution) | An amount necessary to make the pH value to 4.7 |

-continued

| Fixing solution | |
|---|---|
| (Composition B) | |
| Pure water | 17 ml |
| Sulfuric acid (50 w/w % aqueous solution) | 2.5 g |
| Aluminum sulfate (aqueous solution containing 8.1 w/w % of $Al_2O_3$) | 21 g |

Compositions A and B were dissolved in 500 ml of water and make to 1 liter by adding water at the time of use.

| <Processing condition> | | |
|---|---|---|
| Processing | Temperature | Time |
| Developing | 33° C. | 12 sec. |
| Fixing | 35° C. | 10 sec. |
| Washing | Ordinary temp. | 10 sec. |
| Drying | 50° C. | 13 sec. |
| Total | | 45 sec. |

The processing time includes the time for transporting the sample to the next processing tank.

For replenishing the developing solution and the fixing solution, solutions each having the same composition as those of the developing solution and the fixing solution were used, respectively. Thirty square meters of the light-sensitive material was processed while replenishing the developing solution in a ratio of 250 ml/$m^2$ for and the fixing solution in a ratio of 400 ml/$m^2$. During the processing, one sheet of the cleaning sheet or the comparative cleaning sheet each having a size of 25 cm×30 cm was passed through the automatic processor every 3.75 $m^2$of the light-sensitive material.

The evaluation was carried out as follows:

<Silver stain>

To examine degree of the stain formed on the light-sensitive material, a sheet of the unexposed light-sensitive material having a size of 3.5 cm×12 cm was treated by the automatic processor after processing of 30 $m^2$ of the light-sensitive material, and the degrees of formation of the stain and silver sludge are visually classified to the following five ranks.

Rank 5: No silver sludge is formed and the developing solution is clear. The developing tank is not contaminated.

Rank 4: The developing solution is slightly turbid and a slight contamination is formed on the wall of the developing tank. No silver sludge is formed and no silver stain is formed on the processed sample.

Rank 3: The developing solution is turbid and the wall surface of the developing tank is contaminated. Silver stain is slightly observed on the surface of the processed samples but the degree of the stain is acceptable for practical use.

Rank 2: Silver sludge is formed in the developing solution and the contamination of the developing tank cannot be easily removed by washing. An apparent silver stain is observed on the processed sample.

Rank 1: A large amount of silver sludge is formed in the developing tank and silver stain is observed on wide area of the processed sample.

Samples classified as Ranks 1 or 2 are not acceptable for practical use.

<Silver content of the developing solution after processing>

After the treatment by the cleaning sheet, the developing solution was sampled and the silver content of the developing solution was determined by ICP atomic absorption spectrum method.

Results of the evaluation are listed in Table 1.

TABLE 1

| Test No, | Compound contained in the cleaning sheet | Silver stain | Silver content in the developing solution after treatment by the cleaning sheet (ppm) | Solubility of the compound in NaOH aqueous solution having pH 10.00 at 40° C. (g/100 g) | Note |
|---|---|---|---|---|---|
| 1-1 | None | 1 | 29.2 | — | Comp. |
| 1-2 | Comp-1 | 2 | 24.0 | >2 | Comp. |
| 1-3 | Comp-2 | 2 | 21.8 | >3 | Comp. |
| 1-4 | L-16 | 4 | 10.5 | <1 | Inv. |
| 1-5 | L-25 | 4 | 6.2 | <1 | Inv. |
| 1-6 | C-25 | 5 | 2.7 | <1 | Inv. |
| 1-7 | C-49 | 5 | 1.5 | <1 | Inv. |
| 1-8 | Hy-3 | 5 | 2.9 | <1 | Inv. |

Comp-1: Comparative compound, $[NP(OC_6H_2(SO_3Na)_3)_2]_3$
Comp-2: Comparative compound, $[NP(OC_6(SO_3Na)_5)_2]_3$ The silver stain was almost completely prevented by the use of the cleaning sheet as shown in Test Nos. 1-4 to 1-8 according to the invention. In contrast, considerable silver stain was formed in comparative Test Nos. 1-1 to 1-3.

The sensitivity and the fog of the light-sensitive material were not influenced by the treatment by the cleaning sheet according to the invention.

Example 2

<Preparation of beads and filter to be immersed in developing solution>

A gelatin solution having the following composition was prepared and beads having an average diameter of 20 μm were prepared from the solution by a spray-drying method. The compounds of Formula 1 or 2 and the comparative compounds were powdered so that an average diameter of the each compound was made to 100 nm or less before addition to the solution.

| | |
|---|---|
| Gelatin | 100 g |
| Hardener $(CH_2{=}CHSO_2CH_2)_2O$ | 4 g |
| Sodium salt of 2,4-dichloro-6-hydroxy-1,3,5-triazine | 1 g |
| Comparative compound or compound of Formula 1 or 2 | 60 g |

According to the above-method, beads A-1 through A-9 were prepared.

The processing of the light-sensitive material was carried out in the same manner as in Example 1 except that the above-prepared beads A-1 through A-9, beads B-1, B-2 and B'-1, were each immersed in the developing tank of the processor while the running of the processing. The beads were each put in a bag which was water-insoluble and processing solution-permeable such as a cloth bag and immersed in the developing solution. The silver stain and the silver content of the developing solution were determined after processing of 40 sheets of light-sensitive material of 25 cm×30 cm.

Results of the test were shown in Table 2.

TABLE 2

| Test No. | Beads No. | Compound contained in the beads | Silver stain | Silver content of developing solution (ppm) | Note |
|---|---|---|---|---|---|
| 2-1 | A-1 | None | 1 | 28.9 | Comp. |
| 2-2 | A-2 | Comp-1 | 2 | 25.2 | Comp. |
| 2-3 | A-3 | Comp-2 | 1 | 27.1 | Comp. |
| 2-4 | A-4 | L-16 | 4 | 8.7 | Inv. |
| 2-5 | A-5 | L-27 | 4 | 5.5 | Inv. |
| 2-6 | A-6 | C-25 | 4 | 4.1 | Inv. |
| 2-7 | A-8 | C-49 | 5 | 1.3 | Inv. |
| 2-8 | A-9 | Hy-3 | 4 | 3.9 | Inv. |

As is shown in test Nos. 2-4 to 2-8 in Table 2, the silver stain was almost completely prevented by the use of beads according to the invention. Any problem was not observed in the fog and sensitivity of the light-sensitivity after running of the processing. In contrast, considerable silver stain was found in comparative Test Nos. 2-1 to 2-3. In Tests 202 and 2-3, it is cofirmed by ICP atomic absorption spectrometry of the developing solution after processing that the comparable compounds were dissolved out of the sheet to the developing solution. The presece of phosphor atom in the developing solution was detected by the atomic absorption spectromety. When the phosphazene compound is dissolved out of the sheet, the sheet cannot be used repeatedly.

Example 3

Sample of light-sensitive material 3-1 was prepared in the same manner as in Example 1. Further Samples 3-2 to 3-10 were prepared in the same manner as in Sample 3-1 except that the compound of Formula 1 or 2 of the invention or comparative compound Comp-3 was added in the protective layer of each of the sample as shown in Table 3. In the protective layer of each samples except Sample 3-1, the compound of Formula 1 or 2 was added in a form of dispersion prepared by the following procedure. To 230 ml of an aqueous gelatin solution containing 44 g of gelatin, 22 g of the compound of Formula 1 or 2 or a comparative compound dissolved in ethyl acetate was added and dispersed by a power dispersion method under a reduced pressure. Thus obtained dispersion was added to the coating liquid of the protective layer so that the coating amount of the compound was 0.1 g/m$^2$. The amount of gelatin in the protective layer was controlled so as to be 1.1 g/m$^2$ which is the same as that in Sample 3-1. The compound of Formula 1 or 2, or the comparative compound were not added in the protective layer of Sample 3-1. In Sample 3-2, the comporative compound Comp-3 was directly added to the coating liquid of the protective layer since the comparative compound was water-soluble, in such the case the coating amount of the comparative compound and gelatin were controlled 0.1 g/m$^2$ and 1.1 g/m$^2$, respectively.

The samples were processed under the conditions the same as in Test 1 of Example 1 without the use of the cleaning sheet.

Evaluation was carried out according to the followings. Results of the evaluation were shown in Table 3.

Silver stain:

Formation of silver stain was evaluated and ranked in the same manner as in Example 1

Developing rate:

The sample was exposed to He-Ne laser light for a time of $10^{-6}$ minutes and processed under the foregoing conditions. The developing rate is expressed by a relative sensitivity of the sample to the sensitivity obtained in Test No. 3-1, which was set as 100.

Fixing rate:

A time in second for making transparent the unexposed light-sensitive material in the processing solution after processing 30 m$^2$ of the light-sensitive material was measured. The fixing rate was expressed by a relative value with respect to that of Sample No. 3-1 which is set as 100.

TABLE 3

| Sample No. | Compound in light-sensitve material | Silver Stein | Developing rate | Fixing rate | Note |
|---|---|---|---|---|---|
| 3-1 | None | 1 | 100 | 100 | Comp. |
| 3-2 | Comp-3 | 1 | 100 | 102 | Comp. |
| 3-3 | L-7 | 4 | 100 | 103 | Inv. |
| 3-4 | L-16 | 4 | 100 | 105 | Inv. |
| 3-5 | C-17 | 5 | 100 | 105 | Inv. |
| 3-6 | C-25 | 5 | 100 | 100 | Inv. |
| 3-7 | C-49 | 5 | 100 | 105 | Inv. |
| 3-8 | Hy-2 | 5 | 100 | 102 | Inv. |
| 3-9 | Hy-3 | 5 | 100 | 102 | Inv. |

Comp-3: Comparative compound, hexachlorocyclotriphosphazene

It is understood from Table 3 that the silver stain is almost not formed and the sensitivity is not lowered in each of Sample 3-3 to 3-9 containing the compound of the invention. Further, it is found that the fixing ability of the samples according to the invention are not degraded.

Example 4

<Preparation of light-sensitive material>
<Preparation of Seed Emulsion-1>

| | | | |
|---|---|---|---|
| | Seed Emulsion-1 was prepared as follows: | | |
| A1 | Ossein gelatin | 24.2 | g |
| | Water | 9657 | ml |
| | S-5 (10% ethanol-aqueous solution) | 6.78 | ml |
| | Potassium bromide | 10.8 | g |
| | 10% nitric acid | 114 | ml |
| B1 | 2.5N silver nitrate aqueous solution | 2825 | ml |
| C1 | Potassium bromide | 841 | g |
| | Water to make | 2825 | ml |
| D1 | 1.75N potassium bromide aqueous solution An amount necessary to adjust the following silver potential | | |

Nuclei were formed by adding 464.3 ml of Solution B1 and 464.3 ml of Solution C1 to Solution A1 spending 1.5 minutes at 42° C. by a double-jet mixing method using a mixing apparatus described in Japanese Examined Patent Nos. 58-58288 and 58-58289.

After stopping the addition of Solutions B1 and C1, the temperature of Solution A was raised to 60° C. and the pH of the solution was adjusted to 5.0 using 3% KOH solution. Then the remainders of Solution B1 and Solution C1 were each added by the double-jet method for 42 minutes with a flow rate of 55.4 ml/min. The silver potential of the solution during the period of the temperature raising from 42° C. to 60° C. and that of the addition of the Solutions B1 and C1 by the double-jet method was controlled at +8 mV and +16 mV, respectively, by the use of Solution D1. The silver potential was measured by a silver ion selective electrode using a saturated silver-silver chloride electrode as a comparative electrode.

After completion the addition, the pH of the solution was adjusted to 6 by 3% KOH and then the solution was desalted and washed. It was confirmed by an electron microscope that, in the seed emulsion thus obtained, the projection area of hexagonal tabular grains having a maximum adjacent sides of 1.0 to 2.0 account for 90% of the total projection area of the whole grains in the emulsion, and the hexagonal grains have an average thickness of 0.064 μm, an average diameter (a circle equivalent diameter) of 0.595 μm. The valuation coefficient of the thickness was 40% and that of the distance between the twin face was 42%.

<Preparation of Em-1>

A tabular silver halide emulsion Em-1 was prepared using Seed Emulsion-1 and the following four solutions.

| | | |
|---|---|---|
| A2 | Ossein gelatin | 34.03 g |
| | S-5 (10% ethanol aqueous solution) | 2.35 ml |
| | Seed Emulsion-1 | An amount corresponding to 1.218 moles |
| | Water to make | 3150 ml |
| B2 | Potassium bromide | 1734 g |
| | Water to make | 3644 ml |
| C2 | Silver nitrate | 2478 g |
| | Water to make | 4165 ml |
| D2 | Fine grain emulsion composed of 3% by weight of gelatin and silver iodide grain (average diameter of 0.05 μm) An amount corresponding to 0.080 moles | |

*: The fine grain emulsion was prepared by adding 2 liter of a solution containing 7.06 moles of silver nitrate and 2 liter of a solution containing 7.06 moles of potassium iodide to 6.64 liter of a solution containing 5.0% by weight of gelatin spending 10 minutes. The pH and the temperature of the solution during the formation of fine grains was controlled at 2.0 by nitric acid and at 40° C., respectively. After the formation of the fine grains, pH was adjusted to 6.0 using sodium carbonate solution.

Solution A was vigorously stirred in a reaction vessel while maintaining the temperature at 60° C. To the reaction vessel, a part of Solutions B2, a part of Solution C2, and a half of D2 were simultaneously added by a triple-jet method spending 5 minutes. Then the remainder of Solution B2 and a half of remainder of Solution C2 were added spending 37 minutes. Thereafter, a part of Solution B2, a part of Solution C2 and all of the remainder of Solution D2 were added spending 15 minutes, and then all of the remainders of Solution B2 and C2 were added spending 33 minutes. During the above period, pH and pAg were maintained at 5.8 and 8.8, respectively. The adding rates of Solutions A and B were varied as a function of time so as to correspond to the critical growing rate of the silver halide grains.

Furthermore, the above-mentioned Solution D was added in an amount corresponding to 0.15 mole- % of the whole amount of silver to carry out halogen substitution.

After the addition, the emulsion was cooled to 40° C. To the emulsion, 1800 ml of a 13.8% (by weight) solution of gelatin modified by phenylcarbamoyl group (substitution ratio: 90%) was added and stirred for 3 minutes. After adjusting the pH of the emulsion to 4.6 by a 56% (by weight) aqueous solution of acetic acid, the emulsion was stirred for 3 minute and stood for 20 minutes. Then the top clear liquid was removed by decantation. Thereafter, 9.0 liter of distilled water adjusted at 40° C. was added and stirred. After standing, the top clear liquid was removed, and 11.25 liter of distilled water was further added. After standing, the top clear liquid was removed. Then, a gelatin solution and 10% (by weight) solution were added so that the pH was adjusted to 5.80. and stirred for 30 minutes at 50° C. to redisperse the flocculate. After the redispersion, the values of pH and pAg were adjusted to 5.80 and 8.06 at 40° C.

As a result of observation by an electron microscope, the silver halide grains were tabular silver halide grains having an average grain diameter of 1.11 μm, an average thickness of 0.25 μm, an average aspect ratio of 4.5 and a broadness of grain diameter distribution of 18.1%. An average of distance between twin faces in the grain was 0.020 μm. The number of the grains having a ratio of the distance between twin faces to the grain thickness of not less than 5 accounted for 97%, the grains having the ratio of not less than 10 accounted for 49%, the grains having the ratio of not less than 15 accounted for 17%, of the whole number of grains in the emulsion.

A designated amount of a spectral sensitizing dye in a form of a dispersion of solid particles, was added to the emulsion (Em-1) after the temperature of the emulsion was adjusted to 60° C. After 10 minutes of the addition of the dye, adenine, an aqueous solution of a mixture of ammonium thiocyanate and chloroauric acid, and a dispersion of triphenylphosphine selenide were added to the emulsion. After 30 minutes, the silver iodide fine grain emulsion was added. The emulsion was ripened for 2 hours in total. 4-hydroxy-6-methyl-1,3,3a,7-tetraazaindene (TAI) was added at the completion of the ripening.

The added amount (per mole of AgX) of the above additives are listed below.

| | |
|---|---|
| Sodium salt of 5,5-dichloro-9-ethyl-3,3'-di-(sulfopropyl)-oxacarbocyanine anhydrous | 400 mg |
| Sodium salt of 5,5'-di-(butoxycarbonyl)-3,3'-di-(4-sulfobutyl)-benzimidazolocarbocyanine anhydrous | 4.0 mg |
| Adenine | 15 mg |
| Potassium thiocyanate | 95 mg |
| Chloroauric acid | 2.5 mg |
| Sodium thiosulfate | 2.0 mg |
| Triphenylphosphine selenide | 0.2 mg |
| Silver iodide fine grain emulsion | 280 mg |
| 4-hydroxy-6-methyl-1,3,3a,7-tetraazaindene (TAI) | 500 mg |

The solid particle dispersion of the spectral sensitizing dye was prepared according to the method described in JP O.P.I. No. 5-297496. A designated amount of the spectral sensitizing dye was added to water previously adjusted at 27° C. and stirred by a high speed stirrer (dissolver) at 3,500 rpm for 30 to 120 minutes.

The above mentioned dispersion of the selenium sensitizer was prepared as follows. To 30 kg of ethyl acetate adjusted at 50° C., 120 g of triphenylphosphine selenide was added, and completely dissolved by stirring. Besides, 3.8 kg of photographic gelatin was dissolved in 38 kg of pure water, and 93 g of a 25% by weight aqueous solution of sodium dodecylbenzenesulfonate was added to the solution. Then the above two solutions were mixed and dispersed for 30 minutes at 50° C. by a high speed stirring type dispersing apparatus having a dissolver of a diameter of 10 cm with a circumference speed of dispersing blade of 40 m/sec. Then ethyl acetate was removed rapidly under a reduced pressure while stirring so that the remaining concentration of ethyl acetate was become to not more than 0.3% by weight. After that, the dispersion was diluted by pure water to make to 80 kg. A part of thus obtained dispersion was sampled for using in the above-mentioned experiment.

(Preparation of emulsion layer coating liquid)

The following additives were added to the above-obtained emulsion.

| | |
|---|---|
| Compound (G) | 0.5 mg/m$^2$ |
| 2,6-bis(hydroxyamino)-4-diethylamino-1,3,5-triazine | 5 mg/m$^2$ |
| 1,1-dimethylol-1-bromo-1-nitromethane | 70 mg/m$^2$ |
| t-Butylcatechol | 130 mg/m$^2$ |
| Polyvinylpyrrolidone (molecular weight: 10,000) | 35 mg/m$^2$ |
| Styrene/maleic acid anhydrous copolymer | 80 mg/m$^2$ |
| Sodium polystyrenesulfonate | 80 mg/m$^2$ |
| Trimethylolpropane | 350 mg/m$^2$ |
| Diethylene glycol | 50 mg/m$^2$ |
| Nitrophenyl-triphenyl-phosphnium chloride | 20 mg/m$^2$ |
| Ammonium 1,3-hydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Compound (M) | 5 mg/m$^2$ |
| Compound (N) | 5 mg/m$^2$ |
| Colloidal silica (Ludox AM: manufactured by du Pont Co. particle size: 0.013 $\mu$m) | 0.5 mg/m$^2$ |

Gelatin was mixed with the emulsion so that the amount was 1.5 g/m$^2$.

(Preparation of protective layer coating liquid)

A coating liquid of protective layer was prepared so that the coating amounts of ingredients were as follows. In the protective layer of each of Samples 4-3 to 4-9, the compound of Formula 1 or 2 was added as shown in Table 4. The compound was added in the form of the dispersion prepared in the same manner as in Example 3. In Sample 4-2, comparative compound Comp-3 was directly added since the compound is water-soluble. The compound of Formula 1 or 2, or the comparative compound was not added in the protective layer of Sample 4-1.

| | |
|---|---|
| Gelatin* | 0.8 g/m$^2$ |
| Matting agent of polymethylene methacrylate (area average particle diameter: 7.0 $\mu$m) | 50 mg/m$^2$ |
| Hardener $(CH_2{=}CHSO_2CH_2)_2O$ | 36 mg/m$^2$ |
| Sodium salt of 2,4-dichloro-6-hydroxy-1,3,5-triazine | 10 mg/m$^2$ |
| Latex(L) | 0.2 g/m$^2$ |
| Polyacrylamide (average molecular weight: 10,000) | 0.2 g/m$^2$ |
| Sodium polyacrylate | 30 mg/m$^2$ |
| Polysiloxane (SI) | 20 mg/m$^2$ |
| Compound (I) | 12 mg/m$^2$ |
| Compound (J) | 2 mg/m$^2$ |
| Compound (S-3) | 7 mg/m$^2$ |
| Compound (K) | 15 mg/m$^2$ |
| Compound (O) | 50 mg/m$^2$ |
| Compound (S-4) | 5 mg/m$^2$ |
| Compound (F-1) | 3 mg/m$^2$ |
| Compound (F-2) | 2 mg/m$^2$ |
| Compound (F-3) | 1 mg/m$^2$ |
| Compound (1) or (2) of the invention or a comparative compound shown in Table 2 | 0.1 mg/m$^2$ |

*:The amount of gelatin includes gelatin contained in the dispersion of the compound of Formula 1 or 2.

The coating amounts of the materials are described in those per square meter of one side of the light-sensitive material. The coating amount of silver was controlled so as to be 1.6 g/m$^2$ per one side.

(Preparation of crossover-light cutting layer)

On the both sides of a blue tinted polyethylene terephthalate support with a thickness of 175 $\mu$m which was coated with a dispersion of a copolymer of 50% by weight of glycidyl methacrylate, 10% by weight of methyl acrylate and 40% by weight of butyl methacrylate in a concentration of 10% by weight, a crossover-light cutting layer was coated so that the coating amounts per square meter of the compositions was as follows to prepare an support having the crossover-light cutting layers.

| | |
|---|---|
| Solid particle dispersion of Dye (AH) | 50 mg |
| Gelatin | 0.2 g |
| Sodium dodecylbenzenesulfonate | 5 mg |
| Compound (I) | 5 mg |
| Sodium salt of 2,4-dichloro-6-hydroxy-1,3,5-triazine | 5 mg |
| Collodial silica (average particle diameter: 0.014 $\mu$m) | 10 mg |
| Potassium polystryenesulfonate | 50 mg |

Compound (S-3)

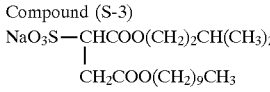

Compound (S-4)

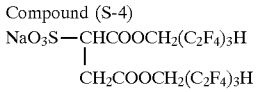

Compound (S-5)

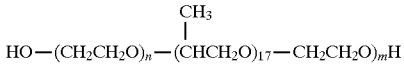

n + m = 5.7

Latex (L)

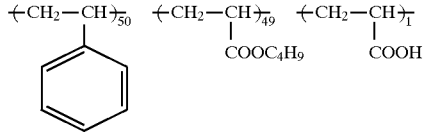

Polysiloxane (SI)

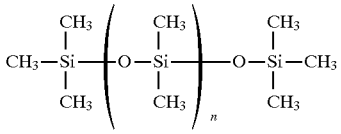

Dispersion of solid particle of dye (AH)

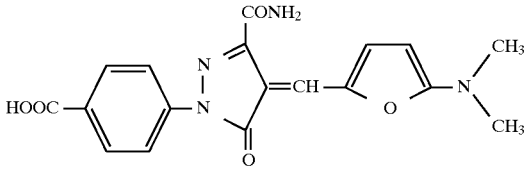

Compound (M)

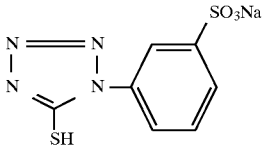

Compound (N)

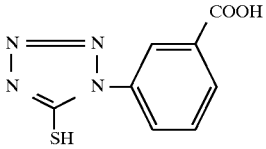

-continued

Compound (G)

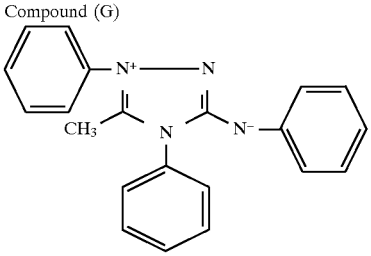

Compound (H)

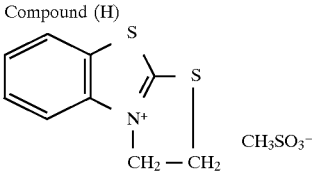

Compound (I)

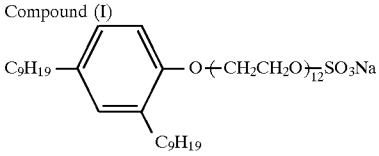

Compound (J)

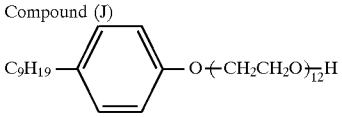

Compound (K)

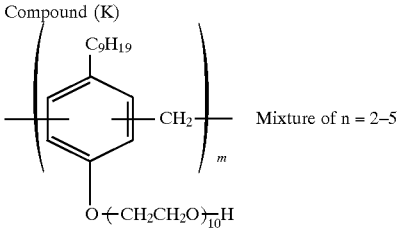

Mixture of n = 2–5

Compound (O)
$C_{11}H_{23}CONH(CH_2CH_2O)_5H$
Compound (F)
$C_9H_{19}O(CH_2CH_2O)_{11}H$ Compound (F-2)
$C_8H_{17}SO_2N(C_3H_7)-(CH_2CH_2O)_{15}H$ Compound (F-3)
$C_8H_{17}SO_2N(C_3H_7)-(CH_2CH_2O)_4-(CH_2)_4SO_3Na$ (Coating of the sample of light-sensitive material)

The above-mentioned liquids were simultaneously coated on both side of the above-obtained support by two slide-hopper type coaters with a speed of 120 m/min and dried for 2 minutes 20 seconds. to make the following layer structure so that the coating amount of silver and gelatin were 1.6 g/m$^2$ and 2.5 g/m$^2$ per one side, respectively, Thus a sample film was prepared.

| Position of layer | Kind of layer | Gelatin amount per one side (g/m$^2$) |
|---|---|---|
| Upper layer | Protective layer | 0.8 |
| Intermediate layer | Emulsion layer | 1.5 |
| Lower layer | Crossover cutting layer | 0.2 |

Thus obtained coated samples were subjected to the following processing and evaluated in a manner similar to that in Example 1, except the developing rate. Results of the evaluation were shown in Table 4.

The evaluation of the developing rate was carried out as follows: the coated sample was put between two sheets of a fluorescent intensifying screen KO-250 (Konica Corporation) and exposed to X-ray irradiation under conditions of a bulb potential of 90 kVp, a current of 20 mA and a time of 0.05 seconds. The irradiation was carried out wedgewise by a distance variation method. Then the sample was processed and subjected to densitometry. A photographic characteristic curve was drawn, and the sensitivity of the sample was determined. The sensitivity was defined by a reciprocal of the amount of X-ray necessary to obtain an optical density of Fog+1.0. The sensitivity was described by a relative value when the sensitivity of Sample No. 4-1 was set as 100.

The processing was carried out by using the following developing solution and fixing solution.

| | |
|---|---|
| Receipt of developing solution | |
| Part A (for 12 l of finished solution) | |
| Potassium hydroxide | 450 g |
| Potassium sulfite (50% solution) | 2280 g |
| Diethylenetetraaminepentaacetic acid | 120 g |
| Sodium hydrogen carbonate | 132 g |
| 5-methylbenzotriazole | 1.2 g |
| 1-phenyl-5-mercaptotetrazole | 0.2 g |
| 1,4-dihydroxybenzene | 340 g |
| Water to make | 5.0 l |
| Part B (for 12 l of finished solution) | |
| Glacial acetic acid | 170 g |
| Triethylene glycol | 185 g |
| 1-phenyl-3-pyrazolidone | 22 g |
| 5-nitroindazole | 0.4 g |
| Receipt of starter (for 1 l of finished solution) | |
| Glacial acetic acid | 120 g |
| Potassium bromide | 225 g |
| Water to make | 1.0 l |
| Receipt of fixing solution | |
| Part A (for 18 l of finished solution) | |
| Ammonium thiosulfate (70 wt/vol-%) | 6000 g |
| Sodium sulfite | 110 g |
| Sodium acetate trihydrate | 450 g |
| Sodium citrate | 50 g |
| Gluconic acid | 70 g |
| 1-N,N-dimethylamino)-ethyl-5-mercaptotetrazole | 18 g |
| Part B (for 18 l of finished solution) | |
| Aluminum sulfate | 800 g |

Preparation of developing solution

Part A and Part B were simultaneously added to 5 l of water and made up to 12 l by addition of water while stirring, and the pH of the solution was adjusted by glacial acetic acid to 10.40 to prepare a developing solution and a developer replenisher.

To the developing solution, the starter solution was added in a ratio of 20 ml per 1 l of the developing solution and the pH was adjusted to 10.26 to prepare a using solution.

Preparation of fixing solution

Part A and Part B were simultaneously added to 5 l of water and finished to 18 l by addition of water while stirring, and the pH of the solution was adjusted by sulfuric acid or sodium hydroxide to 4.4 to prepare a fixing solution and a fixer replenisher.

The processing carried out by an automatic processor (modified SRX-503 manufactured by Konica Corporation). The processing temperature of development, fixing and washing were each 35° C., 33° C. and 20° C., respectively, and drying was carried out by using warmed air at 60° C. and a heat roller having a surface temperature of 80° C. The processing time, dry to dry, was 25 seconds.

Thus obtained results are listed in the following Table 4.

TABLE 4

| Sample No. | Compound in light-sensitve material | Stein | Developing rate | Fixing rate | Note |
|---|---|---|---|---|---|
| 4-1 | None | 1 | 100 | 100 | Comp. |
| 4-2 | Comp-3 | 1 | 100 | 100 | Comp. |
| 4-3 | L-7 | 4 | 100 | 104 | Inv. |
| 4-4 | L-16 | 4 | 100 | 105 | Inv. |
| 4-5 | C-17 | 5 | 100 | 104 | Inv. |
| 4-6 | C-25 | 5 | 100 | 100 | Inv. |
| 4-7 | C-49 | 5 | 100 | 105 | Inv. |
| 4-8 | H-2 | 5 | 100 | 102 | Inv. |
| 4-9 | H-3 | 5 | 100 | 101 | Inv. |

Comp-3: Comparative compound the same as that used in Example 3

It is understood from Table 4 that the developing stain is almost not formed and the developing rate is not lowered in Sample 4-3 to 4-9 each containing the compound of the invention. Further, it is found that the fixing the ability of each of the samples according to the invention is not degraded.

What is claimed is:

1. A method for processing a silver halide photographic light-sensitive material comprising the steps of developing the silver halide photographic light-sensitive material with a developing solution and contacting said developing solution with a member comprising particles of a compound having a structural unit represented by Formula 1 and/or particles of a compound represented by Formula 2, the compound having a structural unit represented by Formula 1 and the compound represented by Formula 2 have each a solubility of not more than 1 g per 100 g of water at 40° C.;

Formula 1

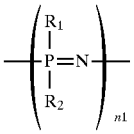

wherein $R_1$ and $R_2$ are each independently an alkyl group, an alkoxy group, an aryl group, an aryloxy group, an alkenyl group, an alkynyl group, an amino group, an alkylthio group, an arylthio group, an acyl group, a cyano group, a cyanato group, an isocyanato group, an isothiocyanato group or an azide group, $n_1$ is an integer of 1 to 50,000, when $n_1$ is 2 or more, $R_1$ and $R_2$ may be the same or different between the structural units;

Formula 2

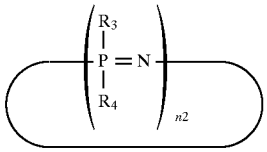

wherein $R_3$ and $R_4$ are synonymous for $R_1$ and $R_3$ in Formula 1, $n_2$ is an integer of 3 to 20, and $R_3$ and $R_4$ may be the same or different between the structural units.

2. The method of claim 1, wherein the member comprises particles of a compound having a structural unit represented by Formula 1.

3. The method of claim 1, wherein the member comprises particles of a compound represented by Formula 2.

4. The method of claim 1, wherein the integer represented by $n_1$ in Formula 1 is within the range of from 1 to 50,000.

5. The method of claim 1, wherein the integer represented by $n_2$ in Formula 2 is within the range of from 3 to 20.

6. The method of claim 1, wherein said member is a bead, a foamed matter each comprising the particles of a water-insoluble compound having the structural unit represented by Formula 1 or the particles of the water-insoluble compound represented by Formula 2, or a sheet having a layer comprising the particles of a water-insoluble compound having the structural unit represented by Formula 1 or the particles of the water-insoluble compound represented by Formula 2.

7. The method of claim 6, wherein said sheet is the silver halide photographic light-sensitive material having a silver halide emulsion layer and optionally a layer and at least one of said layers comprises the particles of a water-insoluble compound having the structural unit represented by Formula 1 or the particles of the water-insoluble compound represented by Formula 2.

8. The method of claim 7, wherein said layer of the silver halide photographic light-sensitive material comprising the particles of a water-insoluble compound having the structural unit represented by Formula 1 or the particles of the water-insoluble compound represented by Formula 2 is a protective layer which is provided on the surface of the silver halide emulsion layer further from the support.

9. The method of claim 6, the layer of said sheet contains the particles of a water-insoluble compound having the structural unit represented by Formula 1 or the particles of the water-insoluble compound represented by Formula 2 in an amount of 10 $mg/m^2$ to 500 $mg/m^2$.

10. The method of claim 6, the layer of said sheet comprises a binder and the particles of a water-insoluble compound having the structural unit represented by Formula 1 or the particles of the water-insoluble compound represented by Formula 2 and a ratio of said particles of the compound is not more than 20% by weight of the binder.

11. The method of claim 1, wherein the using amount of the particles of said compound having the structural unit represented by Formula 1 or the particles of said compound represented by Formula 2 is $2\times10^{-6}$ moles to $2\times10$ moles of the structural unit, —(P=N)—, per liter of developer to be contacted.

* * * * *